US005104052A

United States Patent [19]

Wey et al.

[11] Patent Number: 5,104,052

[45] Date of Patent: Apr. 14, 1992

[54] METHOD AND APPARATUS FOR DRAWING OUT AND SUBSEQUENTLY REWINDING A YARN END ONTO A TEXTILE YARN PACKAGE

[75] Inventors: Edmund Wey, Nettetal; Johann Blask, Mönchengladbach; Hermann Rütten, Viersen; Horst Büttner, Dortmund; Manfred Anderheggen; Uwe Fabelji, both of Mönchengladbach, all of Fed. Rep. of Germany

[73] Assignee: W. Schlafhorst AG & Co., Moenchengladbach, Fed. Rep. of Germany

[21] Appl. No.: 675,698

[22] Filed: Mar. 27, 1991

[30] Foreign Application Priority Data

Mar. 27, 1990 [DE] Fed. Rep. of Germany ..... 4009702

[51] Int. Cl.[5] ..... B65H 54/00

[52] U.S. Cl. ..... 242/18 R; 242/18 EW; 242/35.6 E

[58] Field of Search ..... 242/18 R, 18 EW, 35.5 R, 242/35.6 R, 35.6 E

[56] References Cited

U.S. PATENT DOCUMENTS 4,544,107 10/1985 Matsui et al. ..... 242/35.5 A
4,641,740 2/1987 Grecksch et al. ..... 242/35.5 A
4,909,451 3/1990 Kuepper et al. ..... 242/18 EW
4,911,371 3/1990 Mista ..... 242/35.6 E
4,921,179 5/1990 Surkamp et al. ..... 242/18 R

*Primary Examiner*—Stanley N. Gilreath
*Attorney, Agent, or Firm*—Shefte, Pinckney & Sawyer

[57] ABSTRACT

A method and apparatus are provided for separating a yarn end of a yarn package from the outer layer of the yarn package and disposing the separated yarn end onto the yarn package in a preferred disposition. The apparatus includes a drive device for rotating a yarn package in an unwinding direction, an assembly for performing a yarn end drawing out operation during the unwinding rotation of the yarn package and a device for determining that a successful yarn end drawing out operation has been performed including an assembly for detecting that a yarn end of at least a predetermined length has been drawn out. The apparatus also includes an assembly for controlling the drive device to stop the unwinding rotation of the yarn package in response to the earlier of the lapse of a predetermined period of time and the receipt of a signal from the detecting device indicating that a successful yarn end drawing out operation has been performed. A designation device applies a designation to those yarn packages which do not have a yarn end which has been successfully drawn out, and a reading device and a yarn package transfer device operate together to transfer such unsuccessfully prepared yarn packages.

26 Claims, 4 Drawing Sheets

METHOD AND APPARATUS FOR DRAWING OUT AND SUBSEQUENTLY REWINDING A YARN END ONTO A TEXTILE YARN PACKAGE

BACKGROUND OF THE INVENTION

The present invention relates to a method and apparatus for drawing out and subsequently rewinding a yarn end onto a textile yarn package and, more particularly, to a method and apparatus for separating a yarn end from the outer layer of a textile yarn package and subsequently rewinding the yarn end onto the textile yarn package in a selected manner in accordance with a determination that the yarn end has either been successfully or unsuccessfully drawn out from the outer layer of the yarn package.

One known yarn end preparation method includes the steps of applying suction to the outer layer of a yarn package to draw a yarn end from the outer layer, the application of suction occurring simultaneously with the rotation of the yarn package in an unwinding direction. If the drawing out operation proceeds without any difficulties, the length of yarn which has been drawn out from the yarn package along the suction applying conduit is of a sufficient length to extend past a location at which a yarn end cutting device is disposed. Typically, a sensor is disposed in the suction applying conduit for sensing the travel of a drawn out yarn end beyond a predetermined location in the suction conduit and the yarn end cutting device is actuated in response to the sensing by the sensor of a drawn out yarn end.

Following the step of cutting of a drawn out yarn end, the package is rotated in a winding direction to rewind the now-cut drawn out yarn end onto the outer layer of the yarn package.

In prior methods, if a yarn end drawing out operation fails to draw out a yarn end sufficiently for the sensor in the suction applying conduit to sense the presence of the drawn out yarn end, the yarn package may be deemed to be an unsuitably prepared yarn package. If such yarn packages are further transported along the textile machine, yarn ends, to the extent that they have been drawn out from the outer layer of the yarn package during the yarn end preparation process, may trail behind or alongside the yarn package and detrimentally snag on components of the textile machine along the transport path. This may occur even if the yarn package having an uncut, drawn out yarn end is still subjected to a rewinding step in which the yarn package is rotated in the winding direction to wind the uncut, drawn out yarn end onto the outer layer of the yarn package due to the reason that the yarn end may eventually loosen during further transport of the yarn package.

The snagging of yarn ends on components of the textile machine disadvantageously leads to the formation of more debris and other complications which burden the efficiency of the textile operation. The trailing ends extending loosely from the yarn packages may be eliminated, however, if the yarn end drawing out operation includes steps for detecting and handling yarn ends which have not been successfully drawn out. However, those prior art yarn end drawing out operations which merely rely upon sensing of a drawn out yarn end to initiate the step of rewinding the drawn out yarn end onto the yarn package are not sufficiently flexible to handle instances in which the yarn end has not been successfully drawn out. Accordingly, the need exists for a method and apparatus which detects and separately handles those yarn packages whose yarn ends have not been successfully drawn out so as to minimize the occurrence of trailing ends extending loosely from the yarn packages during subsequent handling of the yarn packages and thereby substatntially avoid detrimental snagging or catching of such loosely extending trailing ends.

SUMMARY OF THE INVENTION

The present invention provides a method and apparatus for advantageously handling yarn packages in a yarn end drawing out operation in such a manner that every packages either has a yarn end successfully dreawn out therefrom or the yarn package is specially handled as a yarn package not having a yarn end which has been successfully drawn out. Those yarn packages not having a yarn end which has been successfully drawn out are deemed to be at risk for the occurrence of trainilg ends extending loosely therefrom if not properly handles and, therefore, the present invention advantageously provides preventative steps for handling such yarn packages to substantially minimize the occurrence of trailing ends. In accordance with the method of the present invention, each yarn package is subjected to a yarn end drawing out operation during which a yarn end must be detected before the lapse of a predetermined period of time. If the predetermined period of time lapses before a yarn end is detected, the yarn package is deemed to be a yarn package not having a yarn end which has been successfully drawn out and the yarn package is accordingly subjected to further steps such as, for example, again subjected to the yarn end drawing out operation, provided with a designation indicating the status of the yarn package, or transferred to a yarn package collecting location for further handling.

Briefly described, the present invention provides and apparatus for separating a yarn end of a yarn package from the outer layer of the yarn package and disposing the separated yarn end onto the yarn package is a preferred disposition thereon for engagement of the disposed yarn end in a subsequent yarn package handling operation. The apparatus includes drive means for rotating a yarn package about its axis in an unwinding direction, means for performing a yarn end drawing out operation in which a yarn end of the yarn package is drawn out from the outer layer of the yarn package during unwinding rotation of the yarn package, and means for determining that a successful yarn end drawing out operation has been performed including means for detecting that a yarn end of at least a predetermined length has been drawn out from the outer layer of the yarn package. Also, the apparatus includes means for controlling the drive means to stop the unwinding rotation of the yarn package in response to the earlier of the lapse of a predetremined period of time and the receipt of a signal from the determining means indicating that a successful yarn end drawing out operation has been performed and means for handling the yarn package subsequent to stopping of the unwinding rotation of the yarn package by the drive means controlling means.

According to one aspect of the apparatus of the present invention, there is also provided means for rewinding a drawn out yarn end onto the yarn package under sufficient tension to substantially minimize trailing ends extending loosely from the yarn packages and therby substantially avoid snagging of catching of such loosely extending trailing ends during subsequent handling of the yarn package, the means for rewinding being operable in response to the lapse of the predetermined period of time before receipt of a signal form the determining means.

According to another aspect of the present invention, there is also provided means for providing a yarn package with a designation for distinguishing between those yarn packages on which a yarn end has not been successfully dreawn out and those yarn packages on which a yarn end has been successfully drawn out.

Accordingly to one feature of the apparatus of the present invention, the means for performing a yean end drawing out operation includes means for applying suction to the outer layer of the yarn package for drawing out a yarn end therefrom, the suction applying means including a suction opening through which a yarn end is drawn into the suction applying means and means for varying the suction force applied to the yarn package by the suction applying means and the means for detecting that a yarn end of at least a predetermined length has been drawn out includes a yarn end sensor disposed at a spacing from the suction opening, the suctin force varying means and the means for rewinding being operated in coordination with one another to insure that an unsuccessfully drawn out yarn end drawn into the suction applying means has sufficient tension during rewinding onto the yarn package to effect tearing of the unsuccessful drawn out yarn end in the event of snagging of the yarn end during rewinding.

In a different feature of the present invention, the apparatus also includes means for transportion a plurality of yarn packages to the means for performing a yarn end drawing out operation for individual performance of a yarn end drawing out operation thereat on each yarn package. In one aspect of the different feature of the apparatus, each yarn package includes yarn built on a tube and the apparatus also includes a plurality of individual package support members for supporting each yarn package in an upright disposition, each individual package support member having an annular portion concentric with the tube of the yarn package supported thereon and the drive means includes means for engaging a selected one of a yarn package and its respective individual package support member for rotating the yarn package about its axis in an unwinding direction.

The drive means preferably includes a drive motor having a drive shaft, a conically shaped tube engaging member mounted to the free end of the drive shaft, and means for selectively moving the conically shaped tube engaging member, the means for vertically moving the conically shaped tube engaging member being operable to selectively move the conically shaped tube engaging member into engagement with the tube of a yarn package for transmitting rotation of the drive shaft to the yarn package and for moving the conically shaped tube engaging member out of engagement with the tube of the yarn package to effect stopping of the rotation of the yarn package.

According to a further feature of the apparatus, each yarn package includes yarn built on a tube and the means for transporting a plurality of yarn packages includes a closed loop yarn package transport device operable to transport yarn packages in a closed loop and having a plurality of individually rotatable pegs rotatably mounted theron, each peg for receiving the tube of a yarn package inserted thereon for individually supporting the yarn package, and the drive means includes means for individually rotating each peg to effect rotation of the yarn package supported on the respective peg. The closed loop yarn package transport device preferably includes a generally annularly shaped plate in which each peg is rotatably mounted and each peg includes an annular foot portion and the means for individually rotating each peg includes an annular drive roller, the means for individually rotating each peg being operable to position the circumference of the annular drive roller in engagement with the circumference of the annular foot portion of each peg for driving rotation of the respective peg.

In yet another aspect of the apparatus of the present invention, the apparatus also includes a device for applying a stream of air to a yarn package to effect loosening of a yarn end thereon, a device for applying a combing action to a yarn package and a reserve winding hook device, each of the devices being positioned adjacent the travel path of the closed loop yarn package transport device for sequentially handling yarn packages positioned thereadjacent in preparation of the yarn packages for a yarn end drawing out operation.

In an additional feature of the apparatus of the present invention, there is provided recirculating means for controlling the closed loop yarn package transport device to re-circulate those yarn packages not having a yarn end which has been successfully drawn out to the means for performing a yarn end drawing out operation for another yarn end drawing out operation. The recirculating means is preferably operatively connected to the controlling means that stops the unwinding rotation of the yarn package, the recirculating means being operable to effect recirculation of a yarn package in response to stopping of rotation upon the lapse of the predetermined period of time before the receipt of a signal from the determining means.

In yet another feature of the apparatus of the present invention, the apparatus includes means for reading a designation applied to a yarn package, the means for handling the yarn package being operable in response to the reading by the yarn package designation reading means of the presence of absence of a designation on a yarn package. The yarn package designation means is preferably operable to apply a designation of one characteristic to those yarn packages not having a yarn end which has been successfully drawn out after one attempt to draw out a yarn end and to apply a designation of another characteristic to those yarn packages not having a yarn end successfully drawn out after another attempt to draw out a yarn end. Also, the means for handling the yarn package is preferably operable to separately handle those yarn packages having a designation of another characteristic in response to a reading thereof by the yarn package designating reading means.

The apparatus preferably additionally includes the features of means for de-activating the device in responses to a signal from the determining means indicating that a yarn end has been successfully drawn out from a yarn package and means for deleting a designation applied to a yarn package by the yarn package designation means, the designation deleting means being positioned upstream of the means for performing a yarn end drawing out operation for deleting the designation of a yarn package, and means for recirculating yarn packages from which designations have been deleted to the means for performing a yarn end drawing out operation.

In an additionlal further feature of the apparatus of the present invention, the apparatus includes means for cutting a drawn out yarn end, the cutting means being operatively connected to the detecting means for cutting a yarn end in response to the detection thereof by the detecting means. Additionally, the apparatus includes means for transferring those yarn packages having a yarn end which has been successfully drawn out from the annular plate to a yarn package transport device and means for transferring those yarn packages not having a yarn end which has been successfully drawn out form the annular plate to a yarn package collecting location.

In another preferred feature of the apparatus of the present invention, there is provided means operable in response to the lapse of the predetermined period of time before receipt of a signal from the determining means for rewinding the drawn out yarn end onto the yarn package under sufficient tension to effect tearing of the drawn out yarn end in the event that the drawn out yarn end snags or otherwise catches on the apparatus during rewinding.

According to another aspect of the present invention, there is provided, a method for separating a yarn end of a yarn package from the outer layer of the yarn package and disposing the separated yarn end onto the yarn package in a preferred disposition thereon in position for engagement during a subsequent yarn package handling operation, comprising rotating the yarn package about its axis in an unwinding direction performing a yarn end drawing out operation on the yarn package to draw out a yarn end from the outer layer thereof during rotration of the yarn package in the unwinding direction, atempting to detect that a yarn end of at least a predetermined length has been drawn out from the outer layer of the yarn package, stopping the unwinding rotation of the yarn package in response to the earlier of the lapse of a predetermined period of time and an indication that a yarn end of at least a predetermined length has been detected and, subsequent to the stopping of the unwinding rotation of the yarn package, handling the yarn package in one manner in response to the lapse of the predetermined period of time before the detection of a yarn end of at least a predetermined length and in a different manner in response to the detection of a yarn end of at lest a predetermined length before the lapse of the predetermined period of time.

The method preferably includes the step of automatically actutating a yarn end cutting device to cut a yarn end drawn out from the outer layer of the yarn package in response to the lapse of the predetermined period of time. Also, the method pereferably includes the step of handling the yarn package including rotating the yarn package in a winding direction in response to the lapse of the predetermined period of time before the detection of a yarn end of at least a predetermined length.

DETAILED DESCRIPTION OF THE PREFERRED EMBODIMENTS

Figure 1:
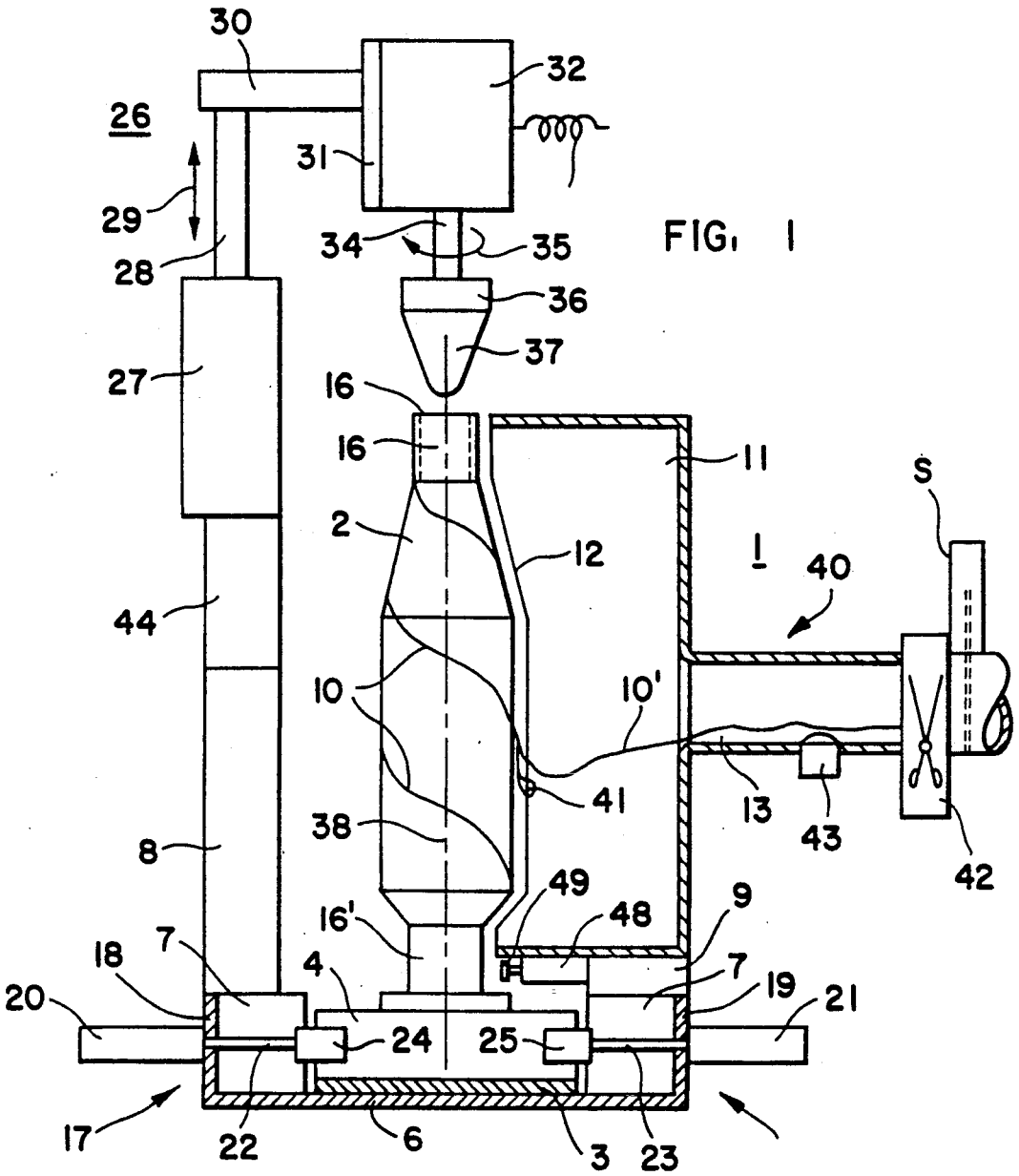
FIG. 1 is a front elevational view, in partial vertical section, of a portion of a textile machine including one embodiment of the yarn end separating and disposing apparatus of the present invention.
Figure 2:
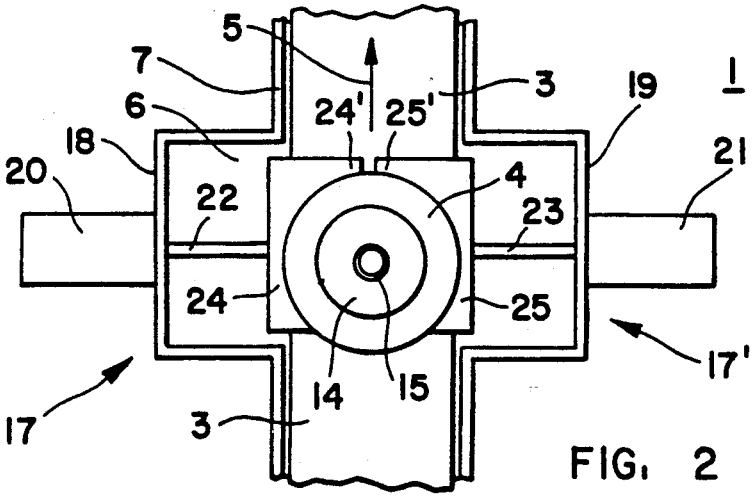
FIG. 2 is a top plan view of a portion of the yarn end separating and disposing apparatus shown in FIG. 1 and showing a yarn package supported for handling by the apparatus.

FIGS. 1 and 2, one embodiment of the yarn end separating and disposing apparatus 1 of the present invention is illustrated in its operative position on a textile machine having a conventional endless member 3 which travels in the direction indicated by the arrow 5 in FIG. 2 to transport a plurality of yarn packages 2, each individually supported on a conventional individual package support member 4, to a preparation station for preparation of a yarn end 10' of the yarn packages 2. Each yarn package 2 is of the type having a reserve winding 10 extending along the outer layer of the yarn package and each yarn package includes yarn build on a tube 16, the tube 16 having a foot oprtion 16' and a top portion 16''.

Each individual package support member 4 includes an annular base portion, an annular neck portion 14 coaxially mounted on the annular base and a peg 15 coaxially mounted on the annular neck portion 14. The peg 15 of each individual package support member 4 is adapted to receive the foot portion 16' of the tube 16 of a yarn package 2 inserted thereon for supporting the yarn package 2 in an upstanding disposition during transport and handling of the yarn package. The outer diameter of the peg 15 of each individual package support member 4 is approximately one millimeter less than the inner diameter of the foot portion 16' of a tube 16 so that each tube 16 fits sufficiently loosely on its respective peg 15 for free rotation of the tube 16 about the axis 38 of the tube to premit rotation of the respective yarn package 2.

The yarn end separating and disposing apparatus 1 includes a conventional reserve winding hooking device 41 for hooking the reserve winding 10 of a yarn package 2 positioned at the yarn end preparation station to effect separation of the reserve winding 10 from the outer layer of the yarn package 2. The yarn end separating and disposing apparatus 1 also includes a suction applying means 40 having a housing 11 defining a slot 12 extending at a length at least as great as the axial extent of the yarn built on each yarn package 2 and a suction conduit 13. The suction conduit 13 is operatively connected to a conventional suction source (not shown) for applying a suction through the slot 12 of the housing 11 and along the suction conduit 13. The suction applying means 40 is mounted on a frame member 9 which is mounted on a transport housing 7. The transport housing 7 includes and endless member support portion 6 for supporting the top run of the endless member 3.

A conventional yarn end sensor 43 is disposed for sensing the presence of a yarn end in the suction conduit 13 at a predetermined location therealong, the yarn end sensor 43 being operatively connected to a control means, illustrated in FIG. 4, which is described in more detail below.

The control means is housed in a control means housing 44 which is mounted to a support frame 8 mounted on the transport housing 7 on an opposite lateral side of the endless member 3 relative to the suction applying means 40.

The suction applying means 40 also includes a conventional yarn end cutting device 42 mounted on the suction conduit 13 at a location downstream of the yarn end sensor 43 for cutting yarn end drawn into the suction conduit 13 through the suction applied through the suction conduit. The yarn end cutting device 42 is operatively connected to the control means. A slide member S is mounted to the suction conduit 13 and operatively connected to the control means. The slide member S is movable between a non-blocking position in which it is out of interference with the path along which the suction is applied through the suction conduit 13 and a partial blocking position in which the slide member S partially blocks the flow of suction through the suction conduit 13.

The yarn end separating and disposing apparatus 1 additionally includes a package support member retaining means 17 having a pair of walls 18, 19, each extending along a respective lateral side of the endless member 3. The yarn end separating and disposing apparatus 1 also includes a pair of releasably retaining members 24, 25, each mounted to the free end of a shaft 22, 23, respectively, of a conventional shaft movement device 20, 21, respectively, which can be in the form, for example, of a conventional hydraulic or pneumatic-piston and cylinder assembly. Each retaining member 24, 25 includes a projecting portion 24', 25', respectively, which, as best seen in FIG. 2, is movable into a retaining position relative to the travel path of the endless member 3 in which the projecting portion 24', 25' prevents further transport of an individual package support member 4 by the endless member 3.

Each retaining member 24, 25 is formed with an arcuate engaging surface compatibly configured with the circumference of the annular base portion of an individual package support member 4 for engagement with the respective individual package support member 4 at the preparation station. Through appropriate control of the shaft movement devices 20, 21, each retaining member 24, 25 is movable between an out of interference position in which the retaining member is retracted into a recess formed transversely of the travel path of the endless member 3 by the wall 18, 19 of the package support member retaining means 17 and a retaining position, shown in solid lines in FIG. 2, in which the retaining member has been moved transversely relative to the travel direction 5 of the endless member 3 into retaining engagement with an individual package support member 4 at the preparation station.

The yarn end separating and disposing apparatus 1 additionally includes a means 26 for rotating a yarn package 2 having a pneumatic rod extending device 27 mounted to the top of the control means housing 44 for selectively raising and lowering a vertically oriented shaft 28 in one of the vertical directions shown by the arrow 29 in FIG. 1. A transverse arm member 30 is mounted to the free end of the rod 38 and extends transversely thereto. The base 31 of a rotation motor 32 is fixedly mounted to the free end of the transverse arm member 30.

The rotation drive motor 32 is connected by a connector 33 to the control means and the rotation drive motor 32 includes a drive shaft 34 supported by the rotation drive motor coaxially with the axis 38 of a yarn package retained at the preparation station and a rotation direction controller M1 which controls the rotation drive motor to rotate the drive shaft 34 in a selected direction. A rotation transmitting member 36 includes a conically shaped tip portion 37 formed of an elastomeric material and adapted for insertion into the top portion 16" of a tube 16 of a yarn package 2 supported at the perparation station.

The rotation transmitting member 36 is mounted to the free end of the drive shaft 34 and is operable to transmit rotation of the drive shaft 34 by the rotation drive motor 32 to the yarn package 2 retained at the preparation station. The tip portion 37 is insertable into rotation transmitting engagement with the top portion 16" of the respective tube 16 through lowering of the rotation drive motor 32 via lowering of the rod 28. In addition to transmitting rotational movement of the drive shaft 34 to the yarn package 2 at the preparation station, the tip portion 37 acts to the center the tube on the peg 15 as it frictionally engages the top portion 16" of the tube for driving rotation of the yarn package about its axis 38.

Figure 4:
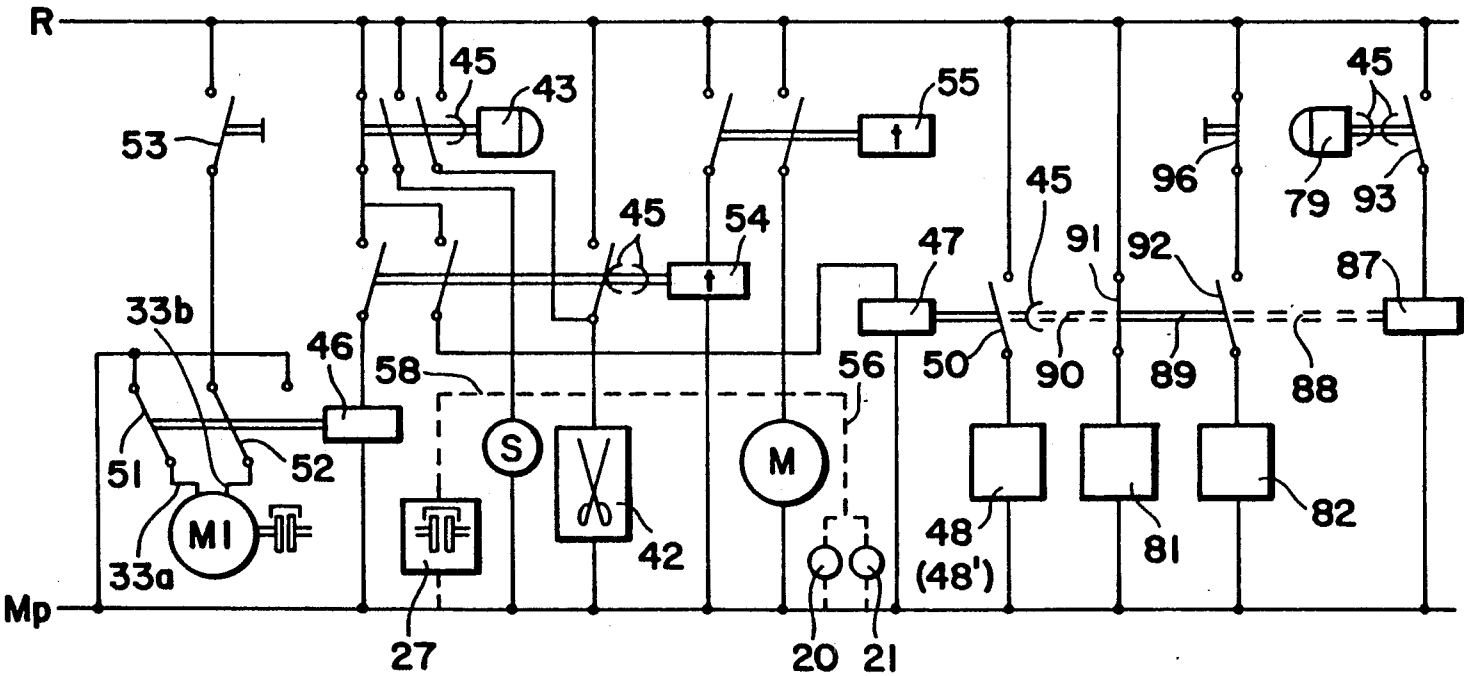
FIG. 4 is a schematic plan view of the control means of the yarn end separating and disclosing apparatus of the present invention.

As seen in FIG. 4, the control means includes a pair of busses R, $M_P$. A switching device 46, which is in the form of a relay, is connected to a pair of contacts 51, 52. Each contact 51, 52 is connected via a line 33*a*, 33*b*, respectively, to the rotation direction controller M1 of the rotation drive motor 32. The switching device 46 is normally in an unexcited state in which it positions the contacts 51, 52 in positions in which the contact 51 connects the line 33*a* to the bus $M_P$ and the contact 52 connects the line 33*b* to another line connected to the bus R having a hand operable switch 53 provided thereon for selectively interrupting the flow along the line from the contact 52 to the bus R. With the contacts 51, 52 positioned as described above by the switching device 46 in the unexcited state of the switching device, the rotation direction control device M1 controls the rotation drive motor 32 to rotate the drive shaft 34 in an unwinding direction opposite to the winding direction indicated by the arrow 35 in FIG. 1.

When the switching device 46 is excited through the supply of voltage thereto from the bus R, it moves the contacts 51, 52 to respective positions in which the contact 51 connects the line 33*a* with the line having the hand operable switch 53 connected to the bus R and the contact 52 to a position in which it connects the line 33*b* to the bus bar $M_P$. With the contacts 51, 52 in these positions, the rotation direction control device M1 is energized to control the rotation drive motor 32 to rotate the drive shaft 34 in the winding direction indicated by the arrow 35 in FIG. 1.

The control means also includes a timing device 54 in the form of a relay having an axially movable bridge connected to three contacts, each contact being operable to connect the bus R with the bus $M_P$ upon closing of the contact. The timing device 54 is provided with a switching delay, schematically shown by the symbol 45 in FIG. 4, for respectively delaying the movement of the three contacts connected to the bridge of the timing relay. One of the three contacts bridged by the relay of the timing device 54 is operatively connected to the switching device 46. Another of the three contacts is operatively connected to another switching device 47 and the third contact is operatively connected to the yarn end cutting device 42.

The yarn end cutting device contact is connected to a contact mounted to the bridge of a relay operatively connected to the yarn end sensor 43. Another contact mounted to the bridge of the relay of the yarn sensor 43 connects the slide member S, which is connected to the bus bar $M_P$, with the bus R upon closing of the contact. A third contact mounted to the bridge of the relay of the yarn end sensor 43 interconnects a common line commonly connected to the two contacts on the bridge of the relay of the timing device 54 with the bus R associated with the switching device 46, 47.

In its normally unexcited state, the relay of the yarn end sensor 43 maintains the contact connected to the slide member S and the contact connected to the yarn end cutting device contact in an open condition. Additionally, in its normal unexcited state, the bridge of the relay of the yarn end sensor 43 maintains the third contact in a closed position in which it interconnects the bus R with the common line leading to the two contacts on the bridge of the relay of the timing device 54 associated with the switching devices 46, 47. The relay of the yarn end sensor 43 immediately moves its bridge to the right as viewed in FIG. 4 when the relay is excited to close the two normally open contacts and open the normally closed third contact. As schematically illustrated by the symbol 45 in FIG. 4, the relay of the yarn end sensor 43 moves its bridge in a delayed movement to the left as viewed in FIG. 4 when the relay changes from an excited state to an unexcited state.

The yarn end cutting device 42 is connected to the bus $M_P$ and is connected to the contacts of the timing device 54 which is operatively connected to one of the two normally open contacts of the relay of the yarn end sensor 43.

The control means also includes a feeding and discharge relay 55 having a bridge operatively connected to a pair of contacts. One of the contacts is connected to the relay of the timing device 54 and this contact is normally held open by the bridge of the feeding and discharge relay 55 in the normal unexcited state of the relay. Upon excitation of the feeding and discharge timing relay 55, the relay moves its bridge to close the contact, thereby connecting the timing device 54 to the bus R.

The other of the pair of contacts connected to the bridge of the feeding and discharge timing relay 55 is connected via a line 56 to the shaft extension devices 20, 21. This contact is normally held upon by the feeding and discharge relay 55 in the normal unexcited state of the relay. Upon excitation of the feeding and discharge timing relay 55, the contact connected to the line 56 closes to connect the shaft extension devices 20, 21 to the bus R.

The rod driving device 27 is connected via a line 58 to the other of the pair of contacts of the feeding and discharge timing relay 55 and is connected to the bus $M_P$. The rod driving device 27 is actuated upon excitation of the feeding and discharge timing relay 55 to lower the rod 28 from its raised position or to raise the rod 28 from its lower position.

The yarn end separating and disposing device 1 also includes a marking device 48 mounted to the underside of the suction housing 11 and having a marking tip 49 selectively extendable into marking engagement with the foot portion 16' of a tube 16 of a yarn package 2 positioned at the preparation station. As seen in FIG. 4, the marking device 48 is connected to the bus $M_P$ and to a normally open contact 50. The normally open contact 50 is connected to the bridge of a relay of the switching device 47. Upon energization of the relay of the switching device 47, the bridge of the relay moves the normally open contact 50 to a closed position in which voltage is supplied from the bus R to the marking device 48.

The control means operates as follows to control the individual feeding of each yarn package 2 to the preparation station, the yarn end drawing out operation performed by the suction applying means 40 and the susequent discharge of the yarm package 2 from the preparation station. Following the completion of a prior yarn end separating end disposing operation, the retaining members 24, 25 are in their out of interference positions in which they are retracted into the recesses formed in the walls 18, 19. As the endless member 3 transports the next following individual package support member 4 into the preparation station, a conventional sensor (not shown) senses the arrival of the individual package support member 4 and causes excitation of the feeding and discharge timing relay 55. Alternatively, the feeding and discharge timing relay 55 may include a clock component which cyclically controls excitation of the relay.

Upon excitation of the feeding and discharge timing relay 55, the two contacts connected to the bridge of the relay close, thereby providing voltage from the bus R to the timing device 54, to the shaft extending devices 20, 21 via the line 56 and to the rod driving device 27 via the line 58. The shaft extending devices 20, 21 extends the retaining members 24, 25 into their retaining positions in which they retain the respective individual package support member 4 which has been transported into the preparation station at the location for handling by the yarn end separating and disposing apparatus 1. The relay of the timing device 54, upon excitation by the voltage supplied from the bus R, moves its bridge, in a delayed manner, to close the three associated contacts to thereby energize the yarn end cutting device 42, the sliding member S and the switching devices 46, 47. The closing of the three contacts asssociated with the relay of the timing device 54 is delayed, as schematically depicted by the symbol 45 in FIG. 4, for a predetermined period of time during which the suction applying means 40 applies a suction to the outer layer of the yarn package 2 to attempt to draw a yarn end 10' sufficiently therein to be sensed by the yarn end sensor 43 and cut by the yarn end cutting device 42.

The closing of the pair of contacts of the feeding and discharge timing relay 55 energizes the rod driving device 27 to effect lowering of the rod 28 and corresponding lowering of the rotation transmitting device 36 into frictional engagement with the top portion 16'' of the tube 16 of the yarn package 2 supported at the prearation station. The hand operated switch 53 is in its normally closed position (unless an operator has opened the switch to place the yarn end separating and disposing device out of operation) and the rotation direction control device M1 is thereby energized to control the rotation driving motor 32 to rotate in the unwinding direction opposite to the arrow 35. Accordingly, as the conical portion 37 of the rotation transmitting device 36 is moved downwardly into contact with the tube of the yarn package 2, the yarn package 2 commences to rotate in the unwinding direction and the reserve winding hooking device 41 hooks the reserve winding 10 on the yarn package 2 to effect loosening and separating of the reserve winding 10 from the yarn package. The suction applying means 40 draws the yarn end 10' of the reserve winding 10 away from the outer layer of the yarn package 2 as the yarn package continues to be rotated in the unwinding direction. The drawn out yarn end 10' is suctioned along the suction conduit 13 under the action of the suction applied through the suction conduit 13 by the suction source.

If the yarn end separating and disposing apparatus 1 is successful in drawing out the yarn end 10' to a length sufficient to activate the yarn end sensor 43, the yarn end 43 detects the presence of the yarn end 10' and energizes its relay. The energization of the relay of the yarn end sensor 43 effects closing of the contact for supplying voltage from the bus R to the yarn end cutting device 42, which is thereby actuated to cut the drawn out yarn end 10', and effects the supply of voltage from the bus R to the sliding member S, which moves from its non-blocking position to its partial blocking position in which it partially blocks the flow of suction through the suction conduit 13. The sliding member S does not completely block the flow of suction along the suction conduit 13; instead, the sliding member S reduces the flow of suction to a predetermined level sufficient to maintain a desired degree of tension in the drawn out yarn end 10' during subsequent rewinding of the yarn end onto the outer layer of the yarn package 2.

The control means then controls the rotation drive motor 32 to rotate the yarn package 2 in the winding direction as shown by the arrow 35 in FIG. 1 to wind the now cut yarn end 10' onto the outer layer of the yarn package.

Upon expiration of the cyclic time as measured by the feeding and discharge timing relay 55, the relay returns its pair of associated contacts to their normally open positions, thereby interrupting the flow of voltage from the bus R via the line 58 to the rod driving device 27 and via the line 56 to the shaft extending devices 20,21. The rod driving device 27 responds to the cessation of voltage by raising the rod 28 to effect disengagement of the rotation transmitting device 36 from the tube 16 of the yarn package 2 at the preparation station. The shaft extending devices 20,21 respond to the cessation of voltage by retracting the retaining members 24,25, respectively, from their retaining positions to their out of interference positions. In correspondence with the movement of the retaining members 24,25 to their out of interference positions, the endless member 3 further transports the respective individual package support member 4 at the preparation station toward another location (not shown) for further handling of the yarn package 2, which now has a yarn end which has been successfully drawn out and subsequently disposed on the outer layer of the yarn package in a preferred disposition.

In some instances, the suction applying means 40 does not successfully draw the yarn end 10' to a sufficient extent along the suction conduit 13 for sensing of the yarn end by the yarn end sensor 43 before the lapse of a predetermined period of time. The relay of the timing device 54 is configured to close its normally open three associated contacts with a delay corresponding to the predetermined period of time. Upon the lapse of the predetermined period of time, the relay of the timing device 54 closes its three normally open contacts. The relay associated with the yarn end sensor 43 is configured with a delay in moving its bridge such that it does not move its bridge before the lapse of the predetermined period of time, whereby the normally closed third contact of the relay of the yarn end sensor 43 remains closed. Accordingly, as the pair of contacts of the relay of the timing device 54 associated with the switching device 46 and the switching device 47 close voltage is provided from the bus R to the two switching devices. The switching device 46 responds to its excitation by moving the bridge of its relay, thereby switching the contacts 51,52 to their respective positions in which the contact 51 supplies voltage to the rotation direction control device M1 from the bus $M_p$ and the contact 52 supplies voltage from the bus R to the rotation direction controlling device M1 to effect a reversal in the direction of rotation of the rotating transmitting device 36. The rotation transmitting device 36 now rotates the yarn package 2 in the winding direction indicated by the arrow 35 in FIG. 1 to wind the uncut yarn end 10' onto the outer layer of the respective yarn package 2 at the preparation station.

In response to its energization, the switching device 47 closes the normally open contact 50 to provide voltage from the bus R to the marking device 48, which responds to the receipt of voltage by extending its marking tip 49 into marking engagement with the foot portion 16' of the tube 16 at the preparation station, thereby marking the tube to indicate that the respective yarn package 2 has not had a yarn end successfully prepared at the preparation station.

The feeding and discharge timing relay 55 then completes its cycle and opens its pair of associated contacts to interrupt the energization of the switching device 54 and to interrupt the energization of the shaft extending devices 20,21, which release the now marked yarn package 2 from the preparation station for further transport by the endless member 3.

Figure 3:
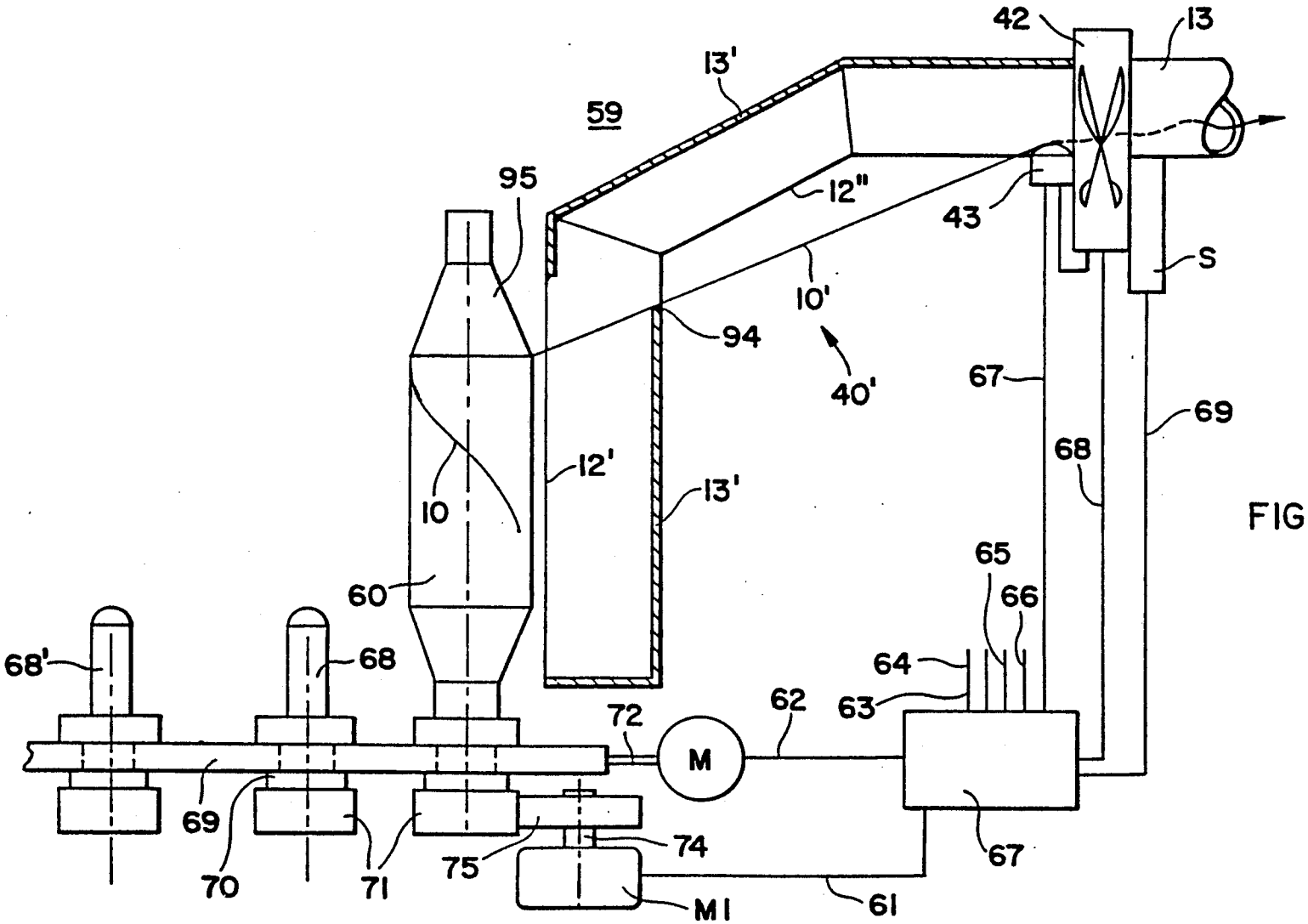
FIG. 3 is a front elevational view, in partial vertical section, of another embodiment of the yarn end separating and disposing apparatus of the present invention.
Figure 5:
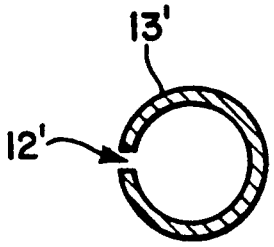
FIG. 5 is a top plan view, in horizontal section, of a portion of the suction applying means of the yarn end separating and disposing apparatus shown in FIG. 3.

In FIG. 3, another embodiment of the yarn end separating and disposing apparatus of the present invention is illustrated. The yarn end separating and disposing apparatus 59 includes a suction applying means 40' comprising a suction housing 13 having an angled tube portion 13'. The angled tube portion 13' forms a slot 12' having an extent substantially equal to the axial extent of a yarn package 60 to be handled by the yarn end separating and disposing apparatus 59. The angled tube portion 13' also includes an intermediate slot 12'' for permitting a yarn end 10' drawn out from the yarn package 60 to extend linearly from the yarn package to a location on the suction housing 13 at which a yarn end sensor 43 is operable to sense the presence of the yarn end. As seen in FIG. 5, the angled tube portion 13' has a cylindrical cross-sectional shape and the slot 12' is formed in an axially extending circumferential gap in the angled tube portion 13'.

A yarn end cutting device 42 is disposed downstream of the yarn end sensor 43 relative to the flow of suction through the suction conduit 13 for cutting a drawn in yarn end 10' in response to the detection of the presence of the yarn end by the yarn end sensor 43. A slide member S is disposed downstream of the yarn end sensor 43 and the yarn end cutting device 42 for selectively reducing or completely blocking the flow of suction through the suction housing 13. The yarn end sensor 43, the yarn end cutting device 42 and the sliding member S are connected via connectors 67,68 and 69, respectively, to a control means for controlling the operation of the yarn end separating and disposing apparatus 59. The control means is housed in a housing 67.

Figure 6:
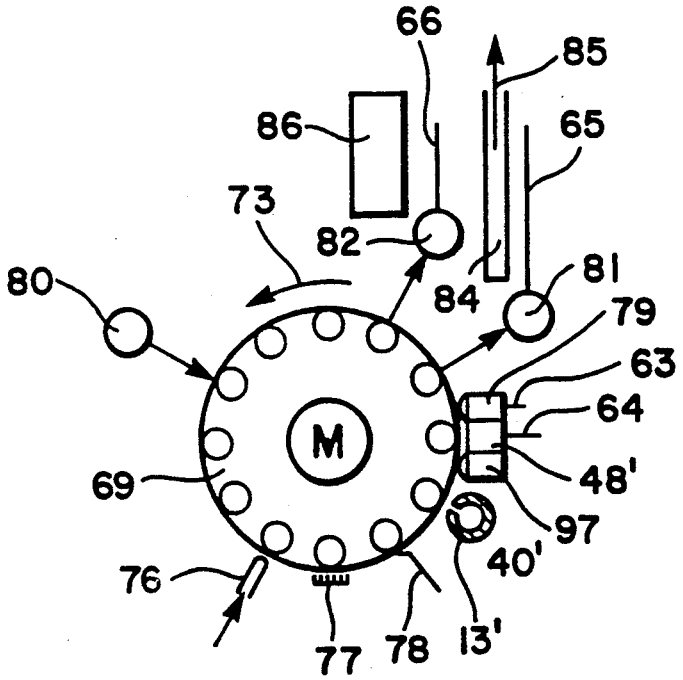
FIG. 6 is a top plan view of a rotary yarn package transport plate of the yarn end separating and disposing apparatus shown in FIG. 3 and showing, in schematic manner, means for separately handling successfully prepared yarn packages and unsuccessfully prepared yarn packages which have been handled by the yarn end separating and disposing apparatus.

As seen in FIGS. 3 and 6, the yarn end separating and disposing apparatus 59 includes a series of stations and a transport means for sequentially transporting a plurality of yarn packages 60 through the stations for the performing of various handling steps on the yarn packages. The transport means is in the form of a rotatable annular plate 69 having a plurality of pegs 68,68' at equal angular spacings from one another for supporting the yarn packages 60 in upstanding dispositions thereon. The pegs 68,68' are individually mounted via conventional bearing assemblies 70 in annular holes in the rotating annular plate 69 for permitting axial rotation of the pegs 68,68'. As seen in FIG. 3, an annular drive roller 71 is mounted to each bearing assembly 70 coaxially with the respective peg 68,68' associated with the bearing assembly 70. A package rotating device 74 includes an annular friction roller 75. The package rotating device 74 is mounted adjacent the annular orbit path of the annular drive rollers 71 as they are moved by the rotation of the annular plate 69. The friction roller 75 is positioned for frictionally engaging the respective annular drive roller 71 of the yarn package 60 positioned adjacent the suction housing 13. A rotation direction control device M1, which is operatively connected via a connector 61 to the control means, controls the direction of rotation of the package rotation device 74 to effect rotation of the respective yarn package 60 in a selected one of the winding and unwinding directions.

The annular plate 69 is operatively connected to a drive motor M for incremental driving of the annular plate 69 in the drive direction 73, as seen in FIG. 6 through a uniform angular displacement. Thus, each yarn package 60 is displaced one uniform angular increment during each incremental movement of the annular plate 69 by the motor M. The motor M is connected to the control means by a connector 62.

As seen in FIG. 6, the yarn end separating and disposing apparatus 59 includes a number of stations for preparing each yarn package 60 for engagement of a yarn end 10' thereof by the suction applying means 40'. A conventional air stream jetting device 76 is positioned for applying jets of air to each yarn package 60 as it passes therepast. A conventional combing device 77 is positioned adjacent the annular plate 69 for applying a combing action to each yarn package 60 following treatment thereof by the air stream jetting device 76. A reserve winding hooking device 78 is positioned adjacent the annular plate 69 for hooking and loosening a reserve winding 10 on each yarn package 60 following treatment thereof by the air stream jetting device 76 and the combing device 77. Each of the devices 76–78 is positioned adjacent the annular plate 69 at a location at which a yarn package 60 is disposed following each incremental angular movement of the annular plate 69.

As seen in FIG. 6, the yarn end separating and disposing apparatus 59 also includes a marking device 79 operatively connected via a connector 64 to the control means. The marking device 48' is operable to mark the exposed bottom portion of the tube of a yarn package 60 positioned adjacent the suction housing 13 in response to a determination by the control means that the yarn end 10' of the yarn package has not been successfully drawn out.

A marking reading device 79 is mounted adjacent the annular plate 69 downstream of the marking device 48' relative to the drive direction 73 of the annular plate 69 and is operatively connected via a connector 63 to the control means. The marking reading device 79 is operable to read a mark disposed on the tube of a yarn package 60 advanced by the annular plate 69 beyond the suction housing 13.

A conventional package transfer device 80 is disposed adjacent the annular plate 69 in advance of the air stream jetting device 76 relative to the drive direction 73 of the annular plate 69 for loading the yarn packages 60 individually onto the peg 68,68'. A normal package transfer device 81 is disposed adjacent the annular plate 69 and is operatively connected via a connector 65 to the control means. The package transfer device 81 is operable to individually transfer a yarn package 60 which has been advanced by the annular plate 69 beyond the marking reading device 79 at a transfer location in advance of the location at which the package transfer device 80 loads the yarn packages 60 onto the annular plate 69. The package transfer device 81 transfers, under control of the control means, those yarn packages having yarn ends which have been successfully drawn out during the handling of the yarn package at the suction applying station 40' to a conventional endless member 84 for further transport of these yarn packages in the direction indicated by the arrow 85 to other yarn package handling locations such as, for example, to a winding station of a textile winding machine.

A remedial package transfer device 82 is disposed adjacent the annular plate 69 and is operatively connected via a connector 66 to the control means. The package transfer device 82 is operable to individually transfer those yarn packages 60 having yarn ends which have not been successfully drawn out to a storage means such as, for example, a container 86, for storage or other handling of the yarn packages.

As seen in FIG. 4, the control means of the yarn end separating and disposing apparatus 59 is substantially similarly configured to the control means of the embodiment of the yarn end separating and disposing apparatus discussed with respect to FIGS. 1 and 2, except for the addition of several components and the absence of some components as more specifically noted hereinafter. The control means as modified to control the operation of the yarn end separating and disposing apparatus 59 does not include any connection 58 or 56 to the rod driving device 27 or the shaft extending devices 20,21 as these devices are not comprised in the yarn end separating and disposing apparatus 59. The control means supplementally includes a relay 87 having a bridge 88. A contact 92 is operatively connected to the bridge 88 for movement thereby between opened and closed positions and is connected to the remedial package transfer device 82, which is itself connected to the bus $M_p$. The contact 92, in its closed position, operatively connects the remedial package transfer device 82 with the bus R for the supplying of voltage from the bus R to the remedial package transfer device.

A contact 91 is operatively connected to an end portion 89 of the bridge 88 and is operable, in its closed position, to connect the normal package transfer device 81 to the bus R. The normal package transfer device 81 is connected to the bus $M_p$ whereby the connection of the contact 91 with the bus R effects the supply of voltage from the bus R to the normal package transfer device 81.

The marking reading device 79 is operatively connected to a relay having a bridge and a contact 93 operatively connected to the bridge. The relay device 87, which is connected to the bus $M_p$, receives voltage from the bus R upon the closing of the contact 93 by the relay to which the marking reading device is connected. As schematically illustrated by the symbol 45 in FIG. 4, the movement of the contact 93 from its normal open position to its closed position is accomplished with a time delay.

A hand operated contact 96 is disposed in line between the contact 92 and bus R. In its closed position, the contact 96 connects the bus R to the lead associated with the contact 92.

The marking device 48' is connected to the bus $M_p$ and to the contact 50 operatively connected to the bridge of the switching device 47.

The yarn end separating and disposing apparatus 59 is operated as follows under the control of the control means to separate a yarn end 10' from each of the yarn packages 60, dispose the drawn out yarn end 10' in a preferred disposition on the yarn package if the yarn end has been successfully drawn out or dispose the yarn end 10' on the yarn package so as to minimize the risk of snagging of the yarn end, and to individually handle the yarn packages in accordance with their condition as either a yarn package having a yarn end which has been successfully drawn out or a yarn package which has not had a yarn end successfully drawn out therefrom. In operation, the timing relay 55 cyclically closes its pair of associated contacts to provide voltage from the bus R to the motor M to effect incremental angular advancement of the annular plate 69. The motor M advances the annular plate 69 through another uniform angular incremental movement to thereby shift each of the yarn packages 60 supported on the pegs 68,68' to the next handling station disposed around the periphery of the annular plate 69. The respective yarn package 60 which is moved adjacent the suction applying means 40' is subjected to the suction applied through the slot 12' to effect separation of the reserve winding 10 from the outer layer of the yarn package.

The reserve winding 10 has previously been subjected to the air stream jetting action of the air stream jetting device 76, the combing action of the combing device 77 and the hooking action of the reserve winding hooking device 78 prior to the movement of the respective yarn package 60 into the position at which the yarn package is subjected to suction action by the suction applying means 40'. If the hand operated switch 53 has previously been closed by an operator prior to the beginning of the respective cycle controlled by the timing relay 55, the rotation direction control device M1 is energized with voltage from the bus R and controls the package rotation device 74 to effect rotation of the respective yarn package 60 in the unwinding direction through frictional engagement of the friction roller 75 with the respective drive roller 71 associated with the peg 68, 68' on which the respective yarn package 60 is supported.

Due to the combination of the rotation of the respective yarn package 60 in the unwinding direction and the application of suction to the outer layer of the yarn package through the slot 12', the previously loosened reserve winding 10 drawn into the suction housing 13 toward the conventional suction source (not shown) located at the downstream end of the suction housing 13. As the reserve winding is drawn out from the outer layer of the respective yarn package 60, the drawn out yarn end 10' moves downwardly through the slot 12'' and is supported on an upper edge 94 of the angled tube portion 13'. As seen in FIG. 3, such a drawn out yarn end 10' extends in a single linear direction from the yarn package 60 to a position adjacent the yarn end sensor 43.

If the drawn out yarn end 10' has been sufficiently drawn out to extend past the yarn end sensor 43, the yarn end sensor 43 senses the presence of the drawn out yarn end 10' and signals the associated relay in the control means which, as seen in FIG. 4, responds to the signal by the yarn end sensor 43 by moving its bridge to close two of its associated contacts and to open its third associated contact. The yarn end cutting device 42 is accordingly supplied with voltage from the bus R and cuts the drawn out yarn end 10' at a location downstream of the yarn end sensor 43. Additionally, the sliding member S is energized to move from its non-blocking to its partial blocking position in the suction housing 13 to reduce the suction force through the angled tube portion 13' to a relatively greatly reduced suction force selected to maintain a minimum tension on the drawn out yarn end 10' after the yarn end has been cut by the yarn end cutting device 42. Since the third associated contact of the relay associated with the yarn end sensor 43 is now open, it is not possible for voltage to be supplied from the bus R to the switching device 46 and the switching device 46 accordingly continues to maintain the contacts 51, 52 in their respective positions in which the rotation direction control device M1 is configured to rotate the yarn package 60 in the unwinding direction.

Once the drawn out yarn end 10' has been cut and is thereafter only subjected to the reduced suction force, the continued rotation of the yarn package 60 in the unwinding direction effects winding of the now cut yarn end 10' onto an upper, conically shaped portion 95 of the yarn package 60. The reduced suction applied to the yarn end 10' during this rewinding operation is selected such that the yarn end is disposed in a relatively loose manner on the upper portion 95 for ready access and removal at a subsequent yarn handling operation.

If the yarn end sensor 43 has energized its relay as described above, the switching element 47 is also not supplied with voltage from the bus R as a consequence of which the marking device 48' remains out of operation and does not mark the tube of the yarn package 60. The timing relay 55 subsequently cycles out and again opens its pair of contacts.

Upon the start of the next cycle initiated by the timing relay 55, the annular plate 69 is advanced another uniform angular increment and the just prepared yarn package 60 with its yarn end 10' now loosely wound about its upper portion 95 is advance past the marking reading device 79 to the position at which the normal package transfer device 81 transfers those yarn packages having yarn ends which have been successfully drawn out.

Since the tube of the yarn package 60 has not previously been marked by the marking device 48', the marking reading device 79 does not detect the presence of a marking on the yarn package 60 and accordingly does not energize its associated relay in the control means. The contact 93 thus remains in its normally open position in which it prevents the supply of voltage from the bus R to the switching device 87 and the switching device 87 continues to maintain the contact 92 in its normally open position and the contact 91 in its normally closed position. The normal package transfer device 81, which is associated with the contact 91, is therefore supplied with voltage from the bus R and operates to transfer the yarn package 60, whose yarn end 10' is disposed in a preferred disposition on the upper portion 95 of the yarn package, to the endless member 84. The remedial package transfer device 82, which is associated with the contact 92, is not supplied with voltage from the bus R in this situation and therefore does not operate to transfer a yarn package.

In the event that the yarn end 10' is incompletely drawn out from the outer layer of the respective yarn package 60, the yarn end separating and disposing apparatus 59 commences a sequence of steps to handle the respective yarn package in a manner which minimizes the risk that the drawn out yarn end 10' will lead to snagging problems. Specifically, the timing device 54, which is energized through one of the pair of the contacts closed by the timing relay 55, moves its bridge with a time delay corresponding to a predetermined period of time during which the yarn end sensor 43 may sense the presence of a drawn out yarn end. If at the lapse of the predetermined period of time the yarn end sensor 43 has not yet sensed a drawn out yarn end—which is an indication that the yarn end 10' has not been drawn out from the yarn package 60 to a length sufficient for the yarn end to enter the sensing area of the yarn end sensor 43—the relay associated with the yarn end sensor 43 is not energized and the third contact associated with this relay remains in its normally closed position and continues to supply voltage from the bus R to the two respective leads associated with the switching element 46 and the switching element 47. Thus, when the bridge of the timing device 54 eventually is moved at the lapse of the predetermined period of time it effects closing of the two respective contacts associated with the switching devices 46, 47 and the switching devices are provided with voltage by the bus R. The switching device 46 responds to its energization by moving the contacts 51, 52 to their respective positions in which the rotation direction control device M1 acts to reverse the rotation of the package rotating device 74 from an unwinding rotation to a winding rotation. The package rotating device 74 thereupon rotates the respective yarn package 60 in the winding direction and the yarn end 10', to the extent that it has been drawn out from the outer layer of the yarn package, is wound back onto the yarn package.

In response to its energization, the switching device 47 moves its bridge to close the contact 50, thereby supplying voltage from the bus R to the marking device 48'. The marking device 48', which can be of the same configuration as the marking device 48 discussed with respect to the embodiment in FIGS. 1 and 2, responds to the supply of voltage by extending its marking applying component to mark the exposed foot portion of the tube 16 of the respective yarn package 60. When the timing relay 55 cycles out and returns its pair of contacts to their normally open position, the supply of voltage to the timing device 54 is thereby interrupted and the timing device 54 returns its three associated contacts to their normally open positions. The switching device 46 responds to the interruption of its energization by moving its associated contacts 51, 52 to their respective positions in which the rotation direction control device M1 controls the package rotating device 74 to rotate the next oncoming yarn package 60 arriving adjacent the suction slot 12' in the unwinding direction.

The annular plate 69 is advanced one uniform annular increment in response to the cycling out of the timing relay 55 and the respective yarn package 60 which has just been marked by the marking device 48' is advanced past the marking reading device 79 during this next incremental advancing movement of the annular plate 69. The marking device 79 detects the presence of a marking on the tube 16 of the respective yarn package 60 and actuates its associated relay via the connector 63 to move the associated contact 93 from its normally open position to a closed position which effects the supply of voltage from the bus R to the switching device 87.

Upon energization, the switching device 87 moves its bridge 88 to effect movement of the contact 92 from its normally open position to a closed position and to effect movement of the contact 91 from its normally closed position to an open position. Voltage is now supplied from the bus R to the remedial package transfer device 82 while the supply of voltage from the bus R to the normal package transfer device 81 is interrupted due to the opening of the contact 91. The most recent incremental angular advance of the annular plate 69 affects advancement of the marked yarn package 60 to the location at which the normal package transfer device 81 engages yarn packages to be transferred and no transfer of the marked yarn package 60 occurs due to the deenergization of the normal package transfer device 81. Upon the nextt incremental advancing movement of the annular plate 69, the remedial package transfer device 82, which continues to be energized due to the delay of the relay associated with the marking reading device 79 in returning the associated contacted 93 to its normally open condition (schematically indicated by the symbol 45 in FIG. 4), transfers the marked yarn package 60 to the container 86.

The yarn end separating and disposing apparatus 59 can be modified as desired to vary the manner in which the yarn packages 60 are handled. For example, the remedial package transfer device 82 can be placed out of operation for a predetermined period of time by manipulation of the hand operated contact 96 to interrupt the supply of voltage from the bus R to the remedial package transfer devicde 82. In this situation, each yarn package 60 which has been deemed as not having a yarn end which has been successfully drawn out is advanced by the annular plate 69 through another circuit during which it is again subjected to the action of the air stream jetting device 76, the combing device 77 and the reserve winding hooking device 78 for preparation of the yarn package to receive another suction applying operation by the suction applying means 40'.

The respective yarn package 60 having a marking on its tube is then subjected to another suction applying operation by the suction applying means 40' to again attempt to successfully draw out a yarn end 10' from the yarn package. If a yarn end is successfully drawn out from the respective yarn package 60 during this second yarn end drawing out attempt (or during another subsequent yarn drawing out attempt), the control means controls the marking deleting device 97 to delete the marking from the tube of the respective yarn package 60 as the yarn package is advanced beyond the suction applying means 40'. The normal package transfer device 81 is then operated in the manner already described to transfer the respective yarn package 60 to the endless member 84 for transport thereby.

The marking deleting device 97 can be configured, for example, as a conventional erasing magnet operable to erase a magnetic-type marking which has been applied to the tube of the yarn packages 60. The marking device 48, 48' can be configured to mark the tube of the yarn package 60 by applying a label thereto. The marking device 48, 48' can also be configured as a conventional encoding device operable to encode a machine readable electronic chip mounted to the tube 16 of each yarn package 60. This configuration of the marking device 48, 48' is particularly advantageous for use in connection with a marking deleting device 97 which is configured to magnetically erase or otherwise delete encoded information loaded onto an electronic chip.

The yarn end separating and disposing apparatus 59 permits an operator to control the remedial package transfer apparatus 82 to periodically transfer those yarn packages 60 not having a yarn end successfully drawn out after such yarn packages have completed a predetermined number of circuits around the travel path of the annular plate 69. To implement such a periodic yarn package transfer step, the operator need only close the hand operated switch 96 to supply voltage from the bus R to the remedial package transfer device 82 if the operator determines that more than a predetermained number of the yarn packages 60 supported on the annular plate 69 circulated through the preparation stations of the apparatus 59 without having their yarn end successfully drawn out. If desired, another switch can be substituted for the hand operated switch and connected to a conventional counting means (not shown) operable to count the number of yarn packages not having a yarn end which has been successfully drawn out. Upon the counting of a predetermined number of such unsuccessfully prepared yarn packages, the counting means provides a signal to the automatic switch to close automatically, thereby providing energization to the remedial package transfer device 82 to effect transfer to effect transfer of the unsuccessfully prepared yarn packages.

In another variation of the yarn package separating and disposing apparatus 59, the control means does not comprise the switching device 87. An interconnecting bridge member 90 is provided having one end connected to the bridge of the switching device 47 and its other end connected to the supplemental bridge portion 89. In this situation, the switching device 47 can be configured with a timing delay, as indicated by the symbol 45 in FIG. 4 which delays the time after energization of the switching device 47 before the switching device moves the contact 91 from its normally closed position to an open position and the contact 92 from its normally open position to its closed position. In this situation, upon the lapse of the predetermined period of time during which the yarn end sensor 43 has an opportunity to sense a yarn end 10 extending therepast, the switching device 47 is energized if the yarn end sensor 43 fails to detect the presence of a yarn end within the predetermined period of time.

Upon its energization, the switching device 47 extends its bridge to close the normally open contact 50, thereby energizing the marking device 48', and the intermediate bridge component 90 and the supplemental bridge portion 89 effect opening of the contact 91 and closing of the contact 92, thereby de-energizing the normal package transfer device 81 and energizing the remedial package transfer device 82. The remedial package transfer device 82 then operates to transfer the respective yarn package 60 once the yarn packages is advanced to the location for transfer. If desired, an operator can open the hand operated switch 96 to prevent energization of the remedial package transfer device 82 in this situation, thereby permitting each yarn package 60 which has not had a yarn end successfully drawn out ot complete a number of circuits through the stations of the yarn end separating and disposing apparatus 59 until the operator again closes the hand operated switch to effect the transfer of such packages from the annular plate 69.

The speed at which a yarn package is rotated in the winding direction to wind thereon a yarn end which has not been successfully drawn out is selected to be a relatively high rotational speed such that any snagging or catching of the yarn end on a portion of the suction applying means is easily overcome due to the relatively high tension on the yarn end resulting from the relatively high rate of rotation of the yarn package 60. Additionally, since the slide member S remains in its non-blocking position during the winding of such yarn ends, any snagged or otherwise caught portions of the yarn end which tear or separate from the yarn end are reliably suctioned away to a waste collecting location (not shown).

The control means of the yarn end separating and disposing apparatus 59 can also be configured to ignore a signal from the marking reading device 79 which indicates that the respective yarn package 60 whose marking is read by the marking reading device has less than a predetermined number of markings thereon (for example, less than two, e.g., one-marking). Thus, each yarn package 60 not having a yarn end which has been successfully drawn out would complete several circuits through the stations of the yarn end separating and disposing apparatus 59 before being transferred.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An apparatus for separating a yarn end of a yarn package from the outer layer of the yarn package and disposing the separated yarn end onto the yarn package in a preferred disposition thereon for engagement of the disposed yarn end in a subsequent yarn package handling operation, comprising:

drive means for rotating a yarn package about its axis in an unwinding direction;

means for performing a yarn end drawing out operation in which a yarn end of the yarn package is drawn out from the outer layer of yarn package during unwinding rotation of the yarn package;

means for determining that a successful yarn end drawing out operation has been performed including means for detecting that a yarn end of at least a predetermined length has been drawn out from the outer layer of the yarn package;

means for controlling said drive means to stop the unwinding rotation of the yarn package in response to the earlier of the lapse of a predetermined period of time and the receipt of a signal from said determining means indicating that a successful yarn end drawing out operation has been performed; and means for handling the yarn package subsequent to stopping of the unwinding rotation of the yarn package by said drive means controlling means.

2. An apparatus according to claim 1 and further comprising means for rewinding a drawn out yarn end onto the yarn package under sufficient tension to substantially minimize trailing ends extending loosely from the yarn packages and thereby substantially avoid snagging or catching of such loosely extending trailing ends during subsequent handling of the yarn package, said means for rewinding being operable in response to the lapse of said predetermined period of time before receipt of a signal from said determining means.

3. An apparatus according to claim 2 wherein said means for handling the yarn package includes means for providing a yarn package with a designation for distinguishing between those yarn packages on which yarn end has not been successfully drawn out and those yarn packages on which a yarn end has been successfully drawn out.

4. An apparatus according to claim 3 and further comprising means for reading a designation applied to a yarn package, said means for handling the yarn package being operable in response to the reading by said yarn package designation reading means of the presence or absence of a designation on a yarn package.

5. An apparatus according to claim 4 and further comprising means for deleting a designation applied to a yarn package by said yarn package designation means, said designation deleting means being positioned upstream of said means for performing a yarn end drawing out operation for deleting the designation of a yarn package, and means for recirculating yarn packages from which designations have been deleted to said means for performing a yarn end drawing out operation.

6. An apparatus according to claim 3 wherein said yarn package designation means is operable to apply a designation of one characteristic to those yarn packages not having a yarn end which has been successfully drawn out after one attempt to draw out a yarn end and to apply a designation of another characteristic to those yarn packages not having a yarn end successfully drawn out after another attempt to draw out a yarn end, and said means for handling the yarn package is operable to separately handle those yarn packages having a designation of said another characteristic in response to a reading thereof by said yarn package designating reading means.

7. An apparatus acccording to claim 3 wherein said yarn package designation device includes means for de-activating said device in response to a signal from said determining means indicating that a yarn end has been successfully drawn out from a yarn package.

8. An apparatus according to claim 2 wherein said means for performing a yarn end drawing out operation includes means for applying suction to the outer layer of the yarn package for drawing out a yarn end therefrom, said suction applying means including a suction opening through which a yarn end is drawn into said suction applying means and means for varying the suction force applied to the yarn package by said suction applying means and said means for detecting that a yarn end of at least a predetermined length has been drawn out includes a yarn end sensor disposed at a spacing from said suction opening, said suction force varying means and said means for rewinding being operated in coordination with one another to insure that an unsuccessfully drawn out yarn end drawn into said suction applying means has sufficient tension during rewinding onto the yarn package to effect tearing of the unsuccessful drawn out yarn end in the event of snagging of the yarn end during rewinding.

9. An apparatus according to claim 2 wherein said means for rewinding includes means for controlling said drive means to reversibly rotate the yarn package in the winding direction in respone to the lapse of said predetermined period of time before the receipt of a signal from said determining means.

10. An apparatus according to claim 1 and further comprising means for transporting a plurality of yarn packages to said means for performing a yarn end drawing out operation for individual performance of a yarn end drawing out operation thereat on each yarn package.

11. An apparatus according to claim 10 wherein each yarn package includes yarn built on a tube and further comprising a plurality of individual package support members for supporting each yarn package in an upright disposition, each individual package support member having an annular portion concentric with the tube of the yarn package supported thereon and said drive means includes means for engaging a selected one of a yarn package and its respective individual package support member for rotating the yarn package about its axis in an unwinding direction.

12. An apparatus according to claim 11 wherein said drive means includes a drive motor having a drive shaft, a conically shaped tube engaging member mounted to the free end of said drive shaft, and means for selectively moving said conically shaped tube engaging member, said means for vertically moving said conically shaped tube engaging member being operable to selectively move said conically shaped tube engaging member into engagement with the tube of a yarn package for transmitting rotation of said drive shaft to the yarn package and for moving said conically shaped tube engaging member out of engagement with the tube of the yarn package to effect stopping of the rotation of the yarn package.

13. An apparatus according to claim 10 wherein each yarn package includes yarn built on a tube and said means for transporting a plurality of yarn packages includes a closed loop yarn package transport device operable to transport yarn packages in a closed loop and having a plurality of individually rotatable pegs rotatably mounted thereon, each said peg for receiving the tube of a yarn package inserted thereon for individually supporting the yarn package, and wherein said drive means includes means for individually rotating each said peg to effect rotation of the yarn package supported on the respective peg.

14. An apparatus according to claim 13 wherein said closed loop yarn package transport device includes a generally annularly shaped plate in which each said peg is rotatably mounted and wherein each said peg includes an annular foot portion and said means for individually rotating each said peg includes an annular drive roller, said means for individually rotating each said peg being operable to position the circumference of said annular drive roller in engagement with the circumference of said annular foot portion of each said peg for driving rotation of the respective peg.

15. An apparatus according to claim 14 and further comprising a device for applying a stream of air to a yarn package to effect loosening of a yarn end thereon, a device for applying a combing action to a yarn package and a reserve winding hook device, each of said devices being positioned adjacent the travel path of said closed loop yarn package transport device for sequentially handling yarn packages positioned thereadjacent in preparation of the yarn packages for a yarn end drawing out operation.

16. An apparatus according to claim 13 and further comprising recirculating means for controlling said closed loop yarn package transport device to re-circulate those yarn packages not having a yarn end which has been successfully drawn out to said means for performing a yarn end drawing out operation for another yarn end drawing out operation.

17. An apparatus according to claim 16 wherein said recirculating means is operatively connected to said controlling means that stops the unwinding rotation of the yarn package, said recirculating means being operable to effect re-circulation of a yarn package in response to stopping of rotation upon the lapse of said predetermined period of time before the receipt of a signal from said determining means.

18. An apparatus according to claim 13 and further comprising means for transferring those yarn packages having a yarn end which has been successfully drawn out from said annular plate to a yarn package transport device and means for transferring those yarn packages not having a yarn end which has been successfully drawn out from said annular plate to a yarn package collecting location.

19. An apparatus according to claim 1 and further comprising means for cutting a drawn out yarn end, said cutting means being operatively connected to said detecting means for cutting a yarn end in response to the detection thereof by said detecting means.

20. An apparatus according to claim 1 and further comprising means operable in response to the lapse of said predetermined period of time before receipt of a signal from said determining means for rewinding said drawn out yarn end onto the yarn package under sufficient tension to effect tearing of the drawn out yarn end in the event that the drawn out yarn end snags or otherwise catches on the apparatus during rewinding.

21. A method for separating a yarn end of a yarn package from the outer layer of the yarn package and disposing the separated yarn end onto the yarn package in a preferred disposition thereon in position for engagement during a subsequent yarn package handling operation, comprising:

rotating the yarn package about its axis in an unwinding direction;

performing a yarn end drawing out operation on the yarn package to draw out a yarn end from the outer layer thereof during rotation of the yarn package in the unwinding direction;

attempting to detect that a yarn end of at least a predetermined length has been drawn out from the outer layer of the yarn package;

stopping the unwinding rotation of the yarn package in response to the earlier of the lapse of a predetermined period of time and an indication that a yarn end of at least a predetermined length has been detected; and subsequent to the stopping of the unwinding rotation of the yarn package, handling the yarn package in one manner in response to the lapse of said predetermined period of time before the detection of a yarn end of at least a predetermined length and in a different manner in response to the detection of a yarn end of at least a predetermined length before the lapse of said predetermined period of time.

22. A method according to claim 21 and further comprising performing another yarn end drawing out operation on the yarn package to draw out a yarn end from the outer layer thereof in response to the lapse of said predetermined period of time before the detection of a yarn end of at least a predetermined length.

23. A method according to claim 21 and further comprising applying a designation to the yarn package in response to the lapse of said predetermined period of time before the detection of a yarn end of at least a predetermined length.

24. A method according to claim 21 wherein the step of handling the yarn package includes transferring the yarn package to a collection location in response to the lapse of said predetermined period of time before the detection of a yarn end of at least a predetermined length.

25. A method according to claim 21 and further comprising automatically actuating a yarn end cutting device to cut a yarn end drawn out from the outer layer of the yarn package in response to the lapse of said predetermined period of time.

26. A method according to claim 21 wherein the step of handling the yarn package includes rotating the yarn package in a winding direction in response to the lapse of said predetermined period of time before the detection of a yarn end of at least a predetermined length.

* * * * *